US007340917B1

(12) United States Patent
Coleman

(10) Patent No.: US 7,340,917 B1
(45) Date of Patent: Mar. 11, 2008

(54) HANDLE/ LIFT ARM ADAPTED TO ELEVATE ICE CHEST TO FACILITATE DRAINING

(76) Inventor: Luke A. Coleman, 2 Second St., Colorado Springs, CO (US) 80906

( * ) Notice: Subject to any disclaimer, the term of this patent is extended or adjusted under 35 U.S.C. 154(b) by 268 days.

(21) Appl. No.: 11/282,399

(22) Filed: Nov. 21, 2005

(51) Int. Cl.
*F25D 3/08* (2006.01)
*F25D 3/02* (2006.01)

(52) U.S. Cl. ..... 62/457.2; 62/459

(58) Field of Classification Search ..... 62/371, 62/372, 459, 461, 462, 464, 457.2, 457.5, 62/457.7; 220/571, DIG. 6; 211/171
See application file for complete search history.

(56) References Cited

U.S. PATENT DOCUMENTS 4,577,475 A * 3/1986 Herrera ..... 62/457.1
5,259,215 A * 11/1993 Rocca ..... 62/371
5,373,708 A * 12/1994 Dumoulin, Jr. ..... 62/457.7
5,605,056 A * 2/1997 Brown et al. ..... 62/457.4
6,336,341 B1 * 1/2002 McGraw et al. ..... 62/420
6,474,097 B2 * 11/2002 Treppedi et al. ..... 62/457.7
6,571,568 B1 * 6/2003 Link ..... 62/244
6,651,456 B1 * 11/2003 White et al. ..... 62/457.7
6,763,678 B2 * 7/2004 Harper ..... 62/461
6,763,959 B2 * 7/2004 Tedder ..... 211/188
6,782,711 B2 * 8/2004 Abfalter ..... 62/457.7
6,796,319 B1 * 9/2004 Patarra et al. ..... 135/16
6,997,007 B1 * 2/2006 Wyatt ..... 62/264

FOREIGN PATENT DOCUMENTS

JP 58-195724 A * 11/1983

* cited by examiner

*Primary Examiner*—Mohammad M. Ali
(74) *Attorney, Agent, or Firm*—G. F. Gallinger

(57) ABSTRACT

A hinge and arm adapted to attach to one end face of a rectangular ice chest, to maintain the one end face of the chest in an elevated position for draining comprising: a hinge having one side attached to the one end face so that its other side swings in a vertical plane; and a swinging arm wherein a lower portion of the arm extends beneath the ice chest to maintain the one end face in an elevated position for draining. In a preferred aspect, the invention further comprises an ice chest and the arm comprises two parallel arms each having one end portion pivoted to the hinge and a handle portion interconnecting the other opposite ends. When the hinge/lift handle is centrally mounted on the one end face and a pivot end portion of the arms is elongated to extend down from the central mounting to the beneath the bottom portion of the box then the hinge additionally functions as a lift handle.

18 Claims, 1 Drawing Sheet

HANDLE/ LIFT ARM ADAPTED TO ELEVATE ICE CHEST TO FACILITATE DRAINING

FIELD OF THE INVENTION

Figure 1:
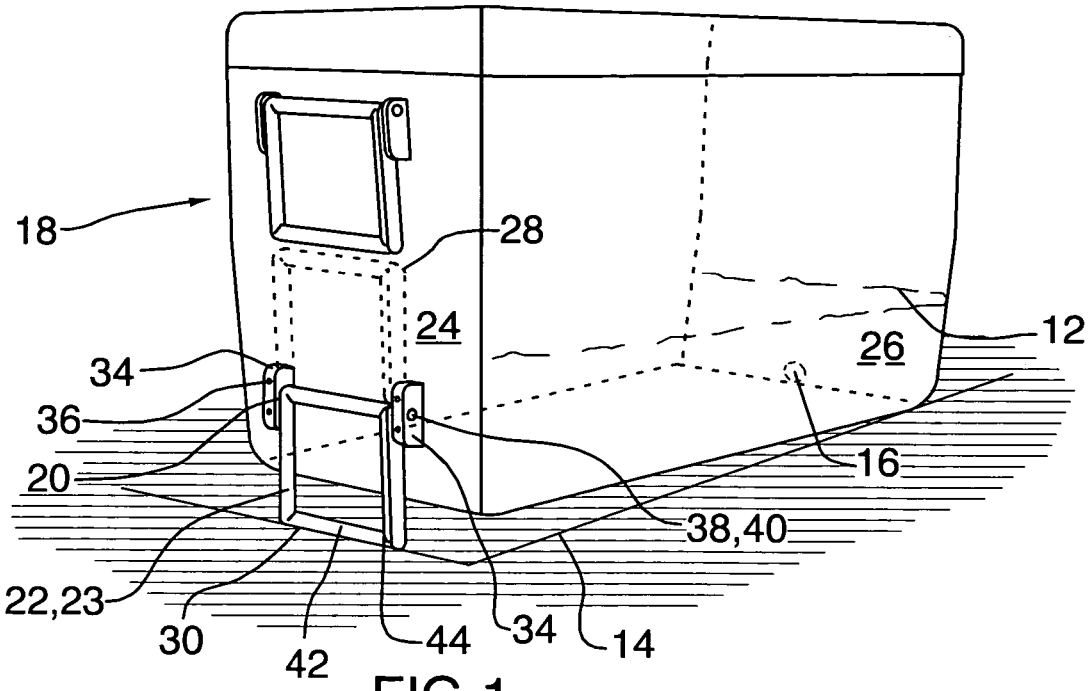

This invention relates to draining ice chests or coolers. More particularly this invention relates to an apparatus adapted to maintain one end of a cooler in an elevated position to facilitate draining melted ice from a drain hole positioned on the other opposite end of the cooler.

BACKGROUND OF THE INVENTION

Ice chests or coolers are commonly used to cool food used by campers and other individuals venturing out-of-doors in the summer for picnics, sports, and other leisure activities. Typically these coolers have an interior volume of approximately two cubic feet. Two cubic feet is a common size because it is the largest size which is convenient to carry. If one intends to maintain food at refrigerated temperatures for 24 hours then it is necessary to fill the cooler almost half full with ice during the summer. The ice filled cooler is too heavy to carry very far, and in no case further than necessary. The following day the cooler must be drained before it is carried to be refilled with ice. To drain the cooler an end of the cooler opposite the drain must be lifted and maintained in an elevated position for several minutes while water slowly streams out of the drain hole on the other opposite end. Leaning over maintaining one end of the food, water, and ice filled cooler in a slightly elevated position by maintaining the cooler handle at a position approximately 8" above ground level, is a strain before a minute has elapsed. After a minute almost everyone must take a break. What is needed is a means of maintaining the one end of the cooler in an elevated position for draining.

OBJECTS OF THE INVENTION

It is an object of this invention to disclose a convenient means for maintaining one end of a cooler elevated to facilitate draining. It is an object of this invention to disclose a convenient and lightweight means attached to the one end of the cooler to support that end of the cooler in an elevated position for draining melted ice therefrom. It is yet a further object of this invention to disclose a hinge and arm adapted to attach to the one end of an existing cooler and thereby retrofit the cooler so that the one end thereof can be conveniently held in an elevated portion while draining. It is yet a further object of this invention to disclose a handle used for lifting the cooler which is adapted to additionally maintain the one end of the cooler in an elevated position for draining melted ice therefrom.

One aspect of this invention provides for a hinge and arm adapted to attach to one end face of a rectangular ice chest, having an opposite end face containing a drain, to maintain the one end face of the chest in an elevated position for draining comprising: a hinge having one side attached to the one end face so that its other side swings in a vertical plane; and a swinging arm having an end portion attached to the other side of the hinge, and an opposite end portion swinging between an upper extreme position adjacent to the end face and a lower extreme position also adjacent to the end face wherein a lower portion of the arm extends beneath the ice chest thereby maintaining the one end face in an elevated position for draining when the ice chest is seated.

In a preferred aspect of this invention further comprises an ice chest and the arm comprises two parallel arms each having one end portion pivoted to the pin and further comprising a handle portion interconnecting the other opposite ends. The hinge additionally functions as a lift handle when the hinge/lift handle is centrally mounted on the one end face and when a pivot end portion of the arms is elongated so that it extends down from the central mounting portion of the chest, to the bottom portion of the box; and, so that when the elongated arms are in an extreme upper position the handle portion is positioned adjacent to a top portion of the end face for lifting.

Various other objects, advantages and features of this invention will become apparent to those skilled in the art from the following description in conjunction with the accompanying drawings.

FIGURES OF THE INVENTION

FIG. 1 is a perspective view of a conventional ice chest retrofitted with a hinge and arm positioned on one end face of the ice chest, opposite the other end face having a drain hole, to maintain the one end in an elevated position for draining.

Figure 2:
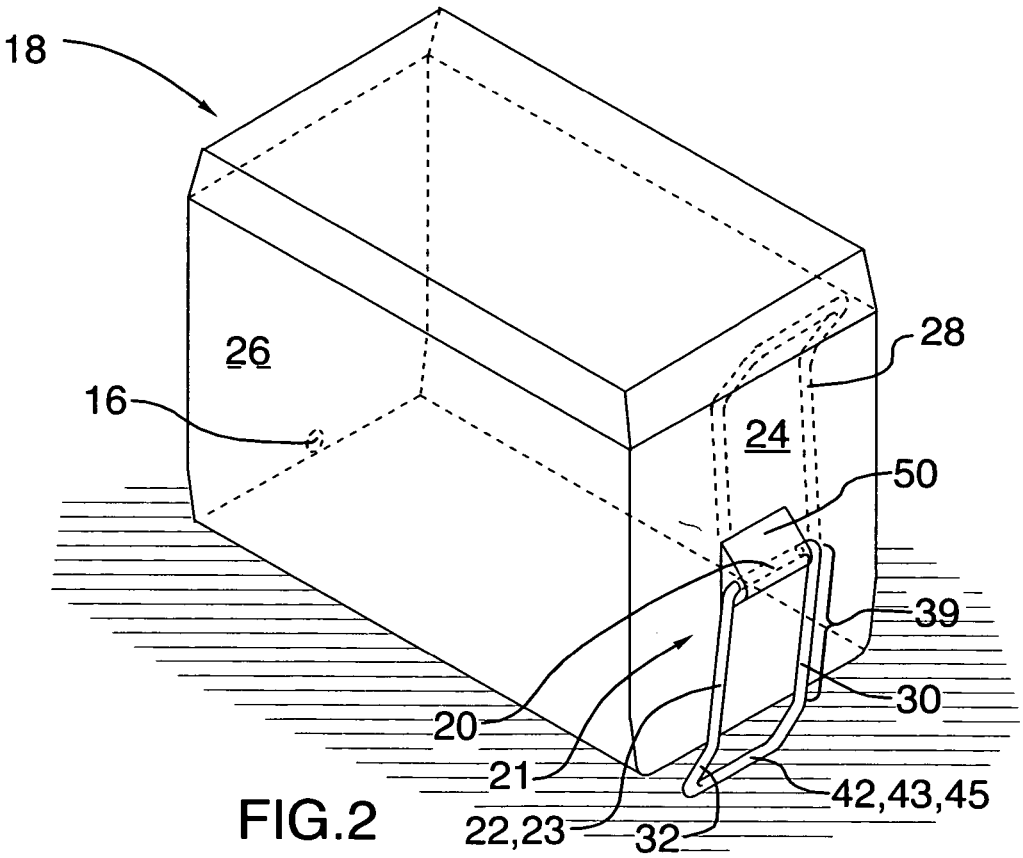

FIG. 2 is a perspective view of an ice chest manufactured with a dual function hinged handle and lift on one end face, opposite the other end face having a drain. When the handle is in the extreme lower position it elevates the one end face of the ice chest. When it is in an extreme raised upper it serves as a handle to lift the one end face of the ice chest.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a conventional cooler 18 retrofitted with a hinge 20 and arm 22 positioned on one end face 24 of the ice chest 18, opposite the other end face 26 having a drain hole 16, to maintain the one end face 24 in an elevated position for draining. A hinge 20 and arm 22 adapted to attach to one end face 24 of a rectangular ice chest 18, having an opposite end face 26 containing a drain 16, to maintain the one end face 24 of the chest 18 in an elevated position for draining comprises: a hinge 20 having one side attached to the one end face 24 so that its other side swings in a vertical plane; and, a swinging arm 22 having an end portion attached to the other side of the hinge 20, and an opposite end portion swinging between an upper extreme position 28 adjacent to the end face 24 and a lower extreme position 30 also adjacent to the end face 24. A lower portion 32 of the arm 22 extends beneath the ice chest 18 thereby maintaining the one end face 24 in an elevated position for draining when the ice chest 18 is seated on a supporting surface 14.

A means to maintain the swinging arm 22 in its upper extreme position 28, which most preferably is friction within the hinge 20 is provided. Most preferably the hinge 20 comprises two spaced blocks 34 each attached to the one end wall face 24, further comprising a pin 38 extending therebetween on which the arm 22 pivots. In one embodiment of the invention the blocks 34 are attached by screws 36 which extend through the blocks 34 into the one end face 24 so that the hinge 20 and arm 22 can be retrofitted to an existing ice chest 18. In the preferred design for retrofit shown in FIG. 1 the pin 38 comprises two shorter pins 40 and the arm 22 comprises two parallel arms 23 each having one end pivoted to one of the shorter pins 40 and further comprising a handle portion 42 interconnecting the other opposite ends.

When the arms 23 are in the extreme lower position 30, the portions of the arms 23 which extend beneath the chest 18 are bent inwardly so that they extend directly beneath the chest 18 and so that the point of contact of the arms 23 on a supporting surface 14 is positioned inwardly from the pivot pin 38 there above. It is noted that the handle portion 42 facilitates hanging the ice chest 18 from a hook (not shown) for storeage.

FIG. 2 is a perspective view of an ice chest 18 manufactured with a dual function hinged handle and lift 21 on one end face 24, opposite the other end face 26 having a drain 16. When the handle and lift 21 is in the extreme lower position 30 it elevates the one end face 24 of the ice chest 18. When it is in an extreme upper position 28 it serves as a handle to lift the one end face 24 of the ice chest 18. A rectangular ice chest 18, having one end face 24 adapted to maintain itself in an elevated position for draining melted ice 12 therefrom, and an opposite end face 26 containing a drain 16, comprises: a hinge 20 having one side attached to the one end face 24 so that its other side swings in a vertical plane; a swinging arm 22 having an end portion attached to the other side of the hinge 20, and an opposite end portion swinging between an extreme upper position 28 adjacent to the end face 24 and a extreme lower position 30 also adjacent to the one end face 24 wherein a lower portion of the arm 32 extends beneath the ice chest 18 thereby maintaining the one end face 24 in an elevated position for draining when the ice chest 18 is seated on a supporting surface 14.

As above a means, which most preferably is friction within the hinge 20, is used to maintain the swinging arm 22 in its upper extreme position 28 when the ice chest 18 is not being drained. And as shown in FIG. 1 the hinge 20 may comprise two spaced blocks 34 each attached to the one end face 24, further comprising a pin 38 extending between the blocks 34 on which the arm 22 pivots. However, if the hinge 20 comprises blocks 34, in the ice chest 18 manufactured with a dual function handle 21, then the blocks 34 are attached through an interior side of the one end face 24.

And as above most preferably the arm 22 comprises two parallel arms 23 each having one end portion pivoted to the pin 38 and further comprising a handle portion 42 interconnecting the other opposite ends. If the pin 38 comprises two shorter pins 40, each of the two parallel arms 23 then pivot on one of the two shorter pins 40.

If when the arms 23 are in the extreme lower position 30, and portions 32 of the arms 23 extending beneath the chest 18, are bent inwardly then those portions 32 are positioned inwardly with respect to the pivot pin 38, and directly under the chest 18. This inward position stably maintains the arm 22 in position even when the chest 18 is supported on a slippery supporting surface 14.

When the hinge 20 additionally functions as a lift handle 43 and wherein the hinge/lift handle 45 is centrally mounted on the one end face 24 and wherein when the arms 23 are in an extreme lower position 30, and if a pivot end portion 39 of the arms 23 is elongated so that it extends down from the central mounting portion of the chest 18, to the bottom portion of the chest 18 where the arms 23 then bend inwardly so that they are positioned directly beneath the chest 18; and, so that when the elongated arms 22 are in an extreme upper position 28 the handle portion 42 is positioned adjacent to a top portion of the end face 24 for lifting.

In one of the most preferred embodiments of the invention the ice chest 18 is molded from plastic and wherein the blocks 34 are replaced by an adjacent portion of the one end face 24 between the pivot end portion of the arms 39 bulges 50 outwardly. Then the pivot pin 38 extends between the arms 32 through the outward bulge 50 in the end face 24.

If the lower portion of the end faces 24, 26 of the ice chest 18 beneath the pivot pin 38 taper inwardly so that when the hinge/lift handle 45 is in the extreme lower supporting position the inward shift of contact of the handle 45 on the supporting surface 14 is accentuated.

While the invention has been described with preferred specific embodiments thereof, it will be understood that this description is intended to illustrate and not to limit the scope of the invention, which is defined by the following claims.

I claim:

1. A hinge and arm adapted to attach to one end face of a rectangular ice chest, having an opposite end face containing a drain, to maintain the one end face of the chest in an elevated position for draining comprising:

a hinge having one side attached to the one end face so that its other side swings in a vertical plane;

a swinging arm having an end portion attached to the other side of the hinge, and an opposite end portion swinging between an upper extreme position adjacent to the end face and a lower extreme position also adjacent to the end face wherein a lower portion of the arm extends beneath the ice chest thereby maintaining the one end face in an elevated position for draining when the ice chest is seated.

2. A hinge and arm as in claim 1 further comprising means to maintain the swinging arm in its upper extreme position when the ice chest is not being drained.

3. A hinge and arm as in claim 2 wherein the means to maintain the swinging arm in in its extreme upper position comprises friction within the hinge.

4. A hinge and arm as in claim 1 wherein the hinge comprises two spaced blocks each attached to the one end face, further comprising a pin extending therebetween on which the arm pivots.

5. A hinge and arm as in claim 4 wherein the blocks are attached by screws which extend through the blocks into the one end face so that the hinge and arm can be retrofitted to an existing ice chest.

6. A hinge and arm as in claim 5 wherein the pin comprises two shorter pins and the arm comprises two parallel arms each having one end pivoted to one of the shorter pins and further comprising a handle portion interconnecting the other opposite ends.

7. A hinge and arm as in claim 6 wherein when the arms are in the extreme lower position, the portions of the arms which extend beneath the chest are bent inwardly so that they extend directly beneath the chest and so that the point of contact of the arms on a supporting surface is positioned inwardly from the pivot pin there above.

8. A rectangular ice chest, having one end face adapted to maintain itself in an elevated position for draining melted ice therefrom, and an opposite end face containing a drain, comprising:

a hinge having one side attached to the one end face so that its other side swings in a vertical plane;

a swinging arm having an end portion attached to the other side of the hinge, and an opposite end portion swinging between an upper extreme position adjacent to the end face and a lower extreme position also adjacent to the end face wherein a lower portion of the arm extends beneath the ice chest thereby maintaining the one end face in an elevated position for draining when the ice chest is seated on a supporting surface.

9. An ice chest as in claim 8 further comprising means to maintain the swinging arm in its upper extreme position when the ice chest is not being drained.

10. An ice chest as in claim 9 wherein the means to maintain the swinging arm in its extreme upper position comprises friction within the hinge.

11. An ice chest as in claim 8 wherein the hinge comprises two spaced blocks each attached to the one end face, further comprising a pin extending between the blocks on which the arm pivots.

12. An ice chest as in claim 11 wherein the blocks are attached through an interior side of the one end face.

13. An ice chest as in claim 12 wherein arm comprises two parallel arms each having one end portion pivoted to the pin and further comprising a handle portion interconnecting the other opposite ends.

14. An ice chest as in claim 13 wherein the pin comprises two shorter pins, each of the two parallel arms pivoting on one of the two shorter pins.

15. An ice chest as in claim 13 wherein when the arms are in the extreme lower position, portions of the arms extending beneath the chest are bent inwardly so that they are positioned inwardly with respect to the pivot pin, and directly under the chest.

16. An ice chest as in claim 15 wherein the hinge additionally functions as a lift handle and wherein the hinge/lift handle is centrally mounted on the one end face and wherein when the arms are in an extreme lower position, a pivot end portion of the arms is elongated so that it extends down from the central mounting portion of the chest, to the bottom portion of the box where the arms then bend inwardly so that they are positioned directly beneath the chest; and, so that when the elongated arms are in an extreme upper position the handle portion is positioned adjacent to a top portion of the end face for lifting.

17. An ice chest as in claim 16 wherein the ice chest is molded from plastic and wherein the blocks are replaced by an adjacent portion of the one end face between the pivot end portion of the arms which bulges outwardly, and wherein the pivot pin extends between the arms through the outward bulge in the end face.

18. An ice chest as in claim 17 wherein the lower portion of the end faces of the ice chest beneath the pivot pin taper inwardly so that when the hinge/lift handle is in the extreme lower supporting position the inward shift of contact of the handle on the supporting surface is accentuated.

* * * * *